US010723511B2

(12) United States Patent
Rajendran

(10) Patent No.: US 10,723,511 B2
(45) Date of Patent: Jul. 28, 2020

(54) MULTIPLE BEVERAGE CONTAINER ASSEMBLY

(71) Applicant: Balaji Rajendran, Coral Springs, FL (US)

(72) Inventor: Balaji Rajendran, Coral Springs, FL (US)

( * ) Notice: Subject to any disclaimer, the term of this patent is extended or adjusted under 35 U.S.C. 154(b) by 55 days.

(21) Appl. No.: 15/968,041

(22) Filed: May 1, 2018

(65) Prior Publication Data

US 2019/0337675 A1 Nov. 7, 2019

(51) Int. Cl.

| | |
|---|---|
| ***B65D 83/00*** | (2006.01) |
| ***B65D 21/02*** | (2006.01) |
| ***B65D 81/38*** | (2006.01) |
| ***A47G 19/22*** | (2006.01) |
| ***B65D 41/04*** | (2006.01) |

(52) U.S. Cl.

CPC ..... *B65D 21/0228* (2013.01); *A47G 19/2272* (2013.01); *A47G 19/2288* (2013.01); *B65D 41/04* (2013.01); *B65D 81/3874* (2013.01)

(58) Field of Classification Search

CPC ..... B65D 21/0228; B65D 41/04; B65D 81/3874; A47J 41/0072; A47G 19/2272; A47G 19/2288

USPC ..... 206/503, 509, 821; 215/6; 220/4.26, 220/4.27, 215, 592.17, 739, 916

See application file for complete search history.

(56) References Cited

U.S. PATENT DOCUMENTS

| | | | | |
|---|---|---|---|---|
| 4,444,324 | A * | 4/1984 | Grenell | B65D 25/04 206/545 |
| 5,405,030 | A | 4/1995 | Frazier | |
| 8,584,882 | B2 | 11/2013 | Hammerle | |
| 8,596,480 | B2 | 12/2013 | Arjomand | |
| 8,925,724 | B1 * | 1/2015 | Normand | B65D 85/72 206/427 |
| D768,507 | S | 10/2016 | Hotell | |
| 2004/0262252 | A1 | 12/2004 | Hammer | |
| 2010/0200438 | A1 | 8/2010 | Davies | |
| 2015/0166245 | A1 * | 6/2015 | Elias | B65D 81/3876 220/739 |
| 2016/0192797 | A1 * | 7/2016 | Yang | A47G 19/2288 220/592.17 |

FOREIGN PATENT DOCUMENTS

| | | |
|---|---|---|
| WO | WO2012059915 | 5/2012 |

* cited by examiner

*Primary Examiner* — Elizabeth J Volz

(57) ABSTRACT

A multiple beverage container assembly for containing a plurality of beverages includes a first sleeve. A disk is removably coupled to the first sleeve such that the first sleeve and the disk forms a first container for containing a first beverage. A first cap threadably engages the first sleeve to close the first sleeve. The first cap has an aperture extending therethrough and a drinking straw can be extended through the aperture. A second sleeve is removably coupled to the disk such that the second sleeve and the disk forms a second container for discretely containing a second beverage with respect to the first beverage. A second cap threadably engages the second sleeve to close the second sleeve.

12 Claims, 5 Drawing Sheets

MULTIPLE BEVERAGE CONTAINER ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to container devices and more particularly pertains to a new container device for containing a plurality of beverages.

BRIEF SUMMARY OF THE INVENTION

An embodiment of the disclosure meets the needs presented above by generally comprising a first sleeve. A disk is removably coupled to the first sleeve such that the first sleeve and the disk forms a first container for containing a first beverage. A first cap threadably engages the first sleeve to close the first sleeve. The first cap has an aperture extending therethrough and a drinking straw can be extended through the aperture. A second sleeve is removably coupled to the disk such that the second sleeve and the disk forms a second container for discretely containing a second beverage with respect to the first beverage. A second cap threadably engages the second sleeve to close the second sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
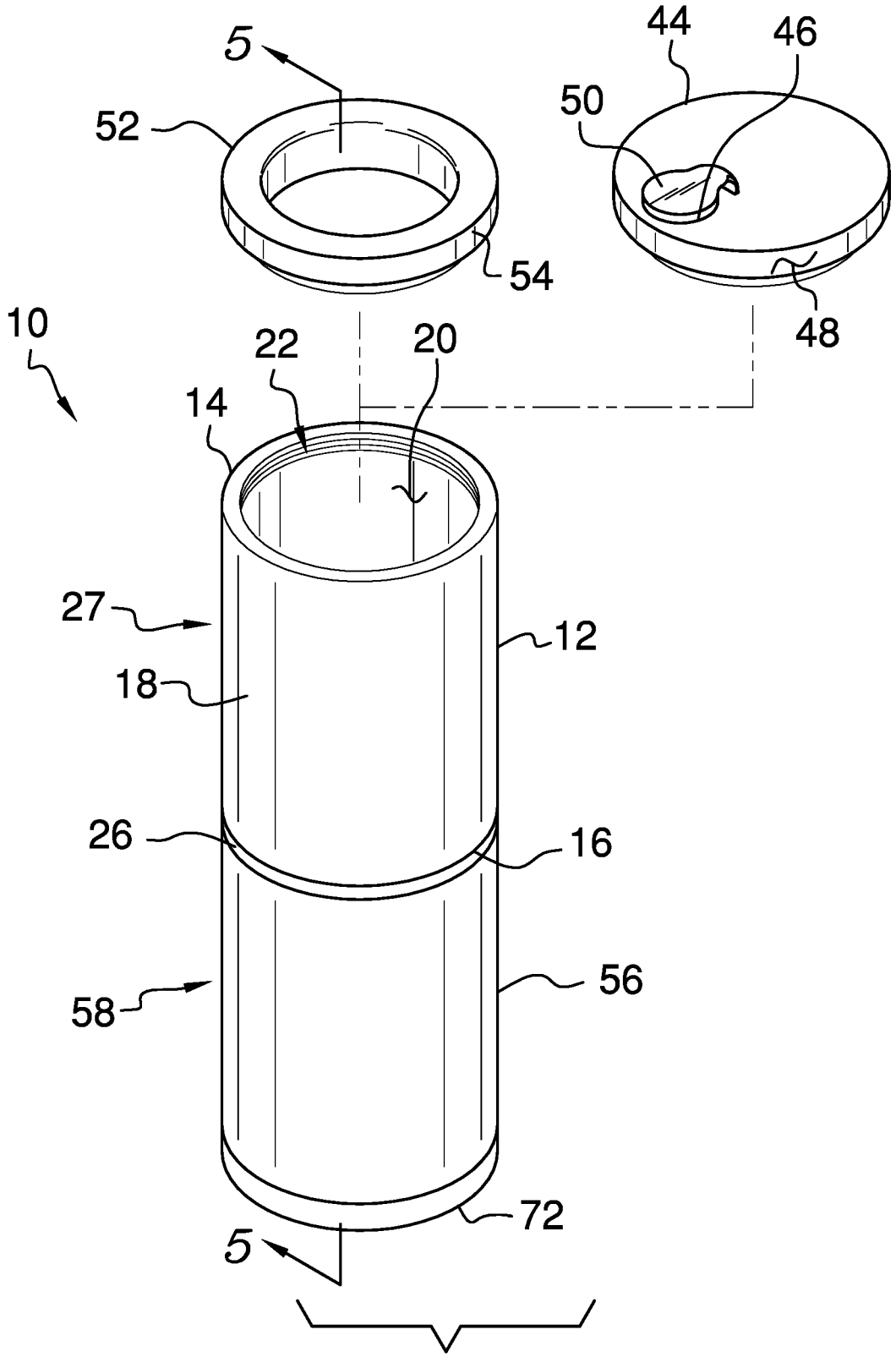
FIG. 1 is a perspective view of a multiple beverage container assembly according to an embodiment of the disclosure.
Figure 2:
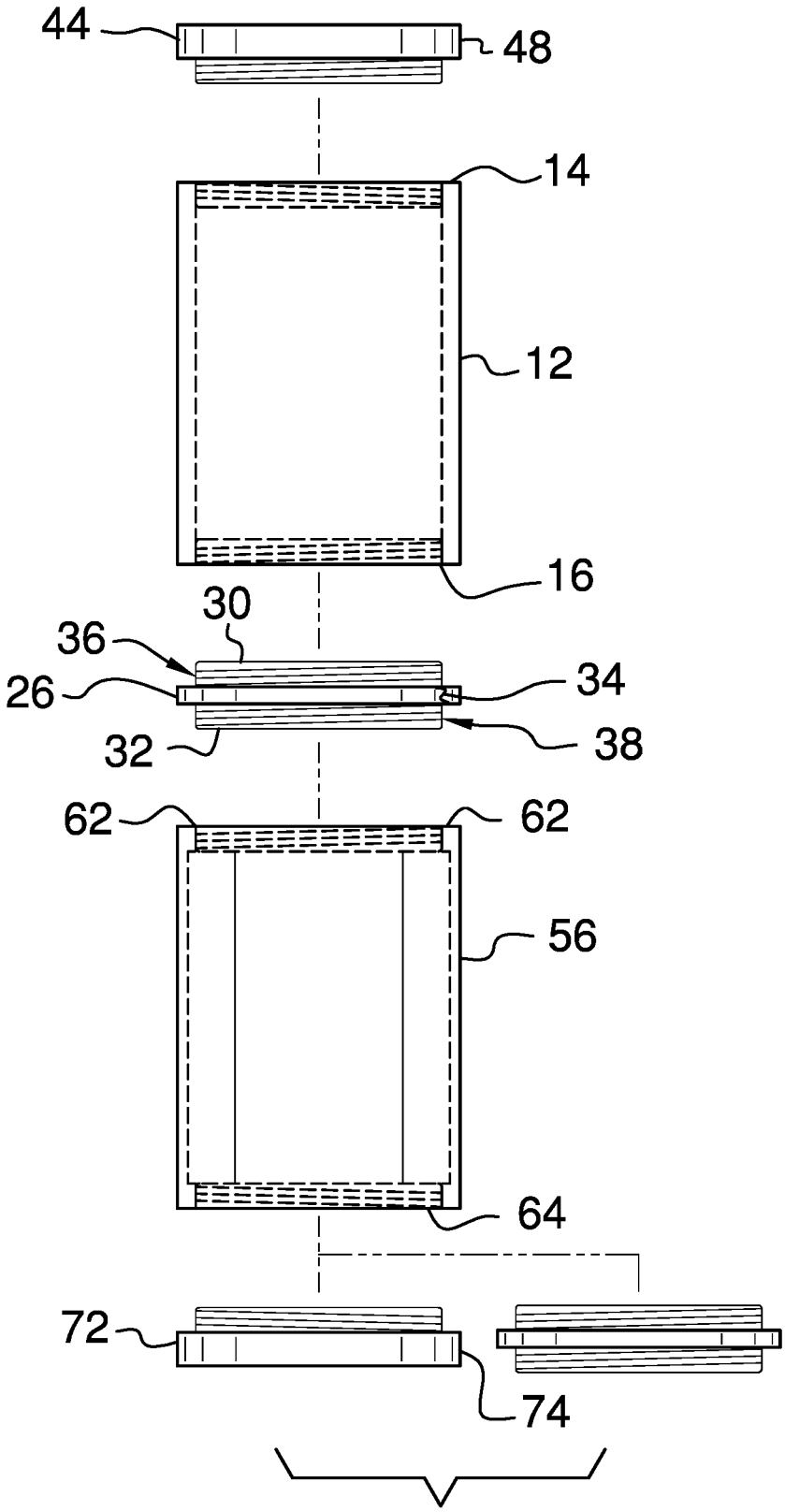
FIG. 2 is an exploded perspective view of an embodiment of the disclosure.

With reference now to the drawings, and in particular to FIGS. 1 through 5 thereof, a new container device embodying the principles and concepts of an embodiment of the disclosure and generally designated by the reference numeral 10 will be described.

As best illustrated in FIGS. 1 through 5, the multiple beverage container assembly 10 generally comprises a first sleeve 12 that has a first end 14, a second end 16 and outer wall 18 extending therebetween. The outer wall 18 has an inner surface 20, and the inner surface 20 has a first threaded portion 22 extending from the first end 14 toward the second end 16. Additionally, the inner surface 20 has a second threaded portion 24 extending from the second end 16 toward the first end 14 and the outer wall 18 is hollow. The first sleeve 12 is comprised of a rigid and fluid impermeable material such as plastic or the like.

A disk 26 is provided and the first disk 26 is removably coupled to the first sleeve 12. Thus, the first sleeve 12 and the disk 26 forms a first container 27 for containing a first beverage 28. The first beverage 28 may be a hot beverage such as coffee or a cold beverage such as soda with ice.

The disk 26 has a primary end 30, a secondary end 32 and an outer surface 34 extending therebetween. The outer surface 34 has a first threaded portion 36 extending from the primary end 30 toward the secondary end 32. The outer surface 34 has a second threaded portion 38 extending from the secondary end 32 toward the primary end 30. The first end 14 of the first sleeve 12 insertably receives the primary end 30 having the first threaded portion 36 of the disk 26 threadably engaging the first threaded portion 22 on the first sleeve 12. Each of the first threaded portion 36 and the second threaded portion 38 is recessed on the outer surface 34 of the disk 26. The disk 26 forms a fluid impermeable seal with the first sleeve 12 and the disk 26 is hollow.

A first insulator 40 is positioned within the outer wall 18 of the first sleeve 12 and the first insulator 40 is comprised of a thermally insulating material. Thus, the first insulator 40 inhibits thermal communication between the first beverage 28 and ambient air. A second insulator 42 is positioned within the disk 26 and the second insulator 42 is comprised of a thermally insulating material. Thus, the second insulator 42 inhibits thermal communication between the first beverage 28 and ambient air. Each of the first 40 and second 42 insulators serve to retain the hot beverage at a hot temperature and the cool beverage at a cool temperature.

A first cap 44 is provided and the first cap 44 threadably engages the first sleeve 12 to close the first sleeve 12. The first cap 44 has an aperture 46 extending therethrough and a drinking straw can be extended through the aperture 46. The first cap 44 has an outer edge 48 and the outer edge 48 is threaded to threadably engage the first threaded portion 22 of the first sleeve 12. The threads on the first cap 44 are recessed on the outer edge 48. A flap 50 is coupled to the first cap 44 and the flap 50 selectively closes the aperture 46.

A ring 52 is provided and the ring 52 has an outside edge 54. The outside edge 54 is threaded to threadably engage the first threaded portion 22 of the first sleeve 12 for facilitating the first beverage 28 to be drank through the ring 52. Additionally, the threads on the ring 52 are recessed on the outside edge 54.

A second sleeve 56 is removably coupled to the disk 26 such that the second sleeve 56 and the disk 26 forms a second container 58 for discretely containing a second beverage 60 with respect to the first beverage 28. Thus, the first 12 and second 56 sleeves facilitate two different beverages to be simultaneously transported. The second sleeve 56 has a primary end 62, a secondary end 64 and an inside surface 66. The inside surface 66 has a primary threaded portion 68 extending from the primary end 30 toward the secondary end 32. Additionally, the inside surface 66 has a secondary threaded portion 70 extending from the secondary end 32 toward the primary end 30.

The primary end 30 insertably receives the secondary end 32 of the disk 26 having the second threaded portion 24 on the disk 26 threadably engaging the primary threaded portion 68 on the second sleeve 56. The disk 26 forms a fluid impermeable seal with the second sleeve 56. A second cap 72 is provided and the second cap 72 threadably engages the second sleeve 56 to close the second sleeve 56. The second cap 72 has an outwardly facing surface 74. The outwardly facing surface 74 is threaded to threadably engage the secondary threaded portion 70 on the second sleeve 56 to close the second sleeve 56. Moreover, the threads on the second cap 72 are recessed on the outwardly facing surface 74 and the second cap 72 is hollow. A third insulator 76 is positioned within the second cap 72 and the third insulator 76 is comprised of a thermally insulating material to inhibit thermal communication between the second beverage 60 and ambient air.

Figure 3:
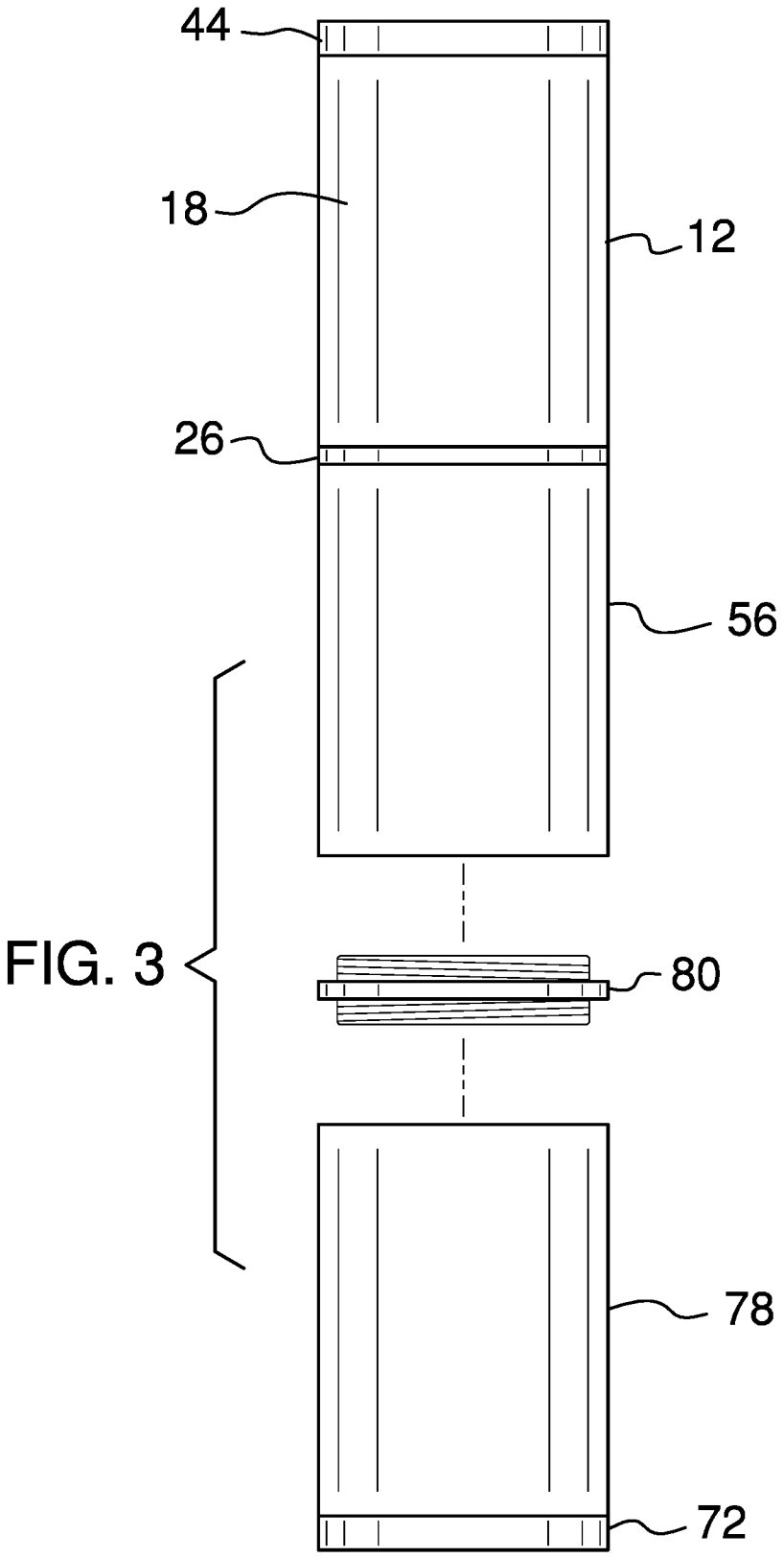
FIG. 3 is a perspective view of showing a third sleeve and an additional disk of an embodiment of the disclosure.
Figure 4:
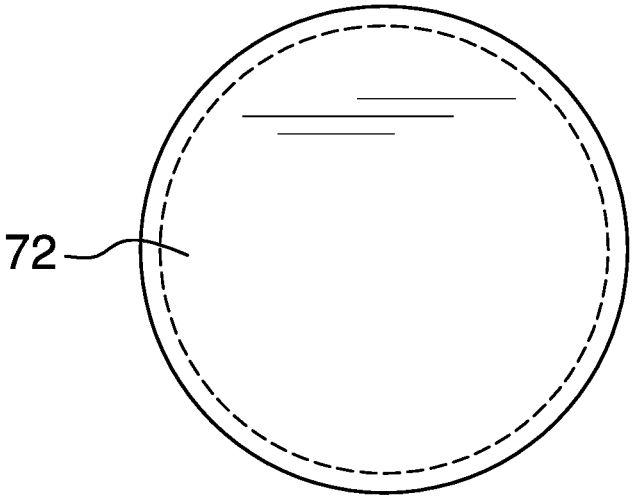
FIG. 4 is a bottom phantom view of an embodiment of the disclosure.
Figure 5:
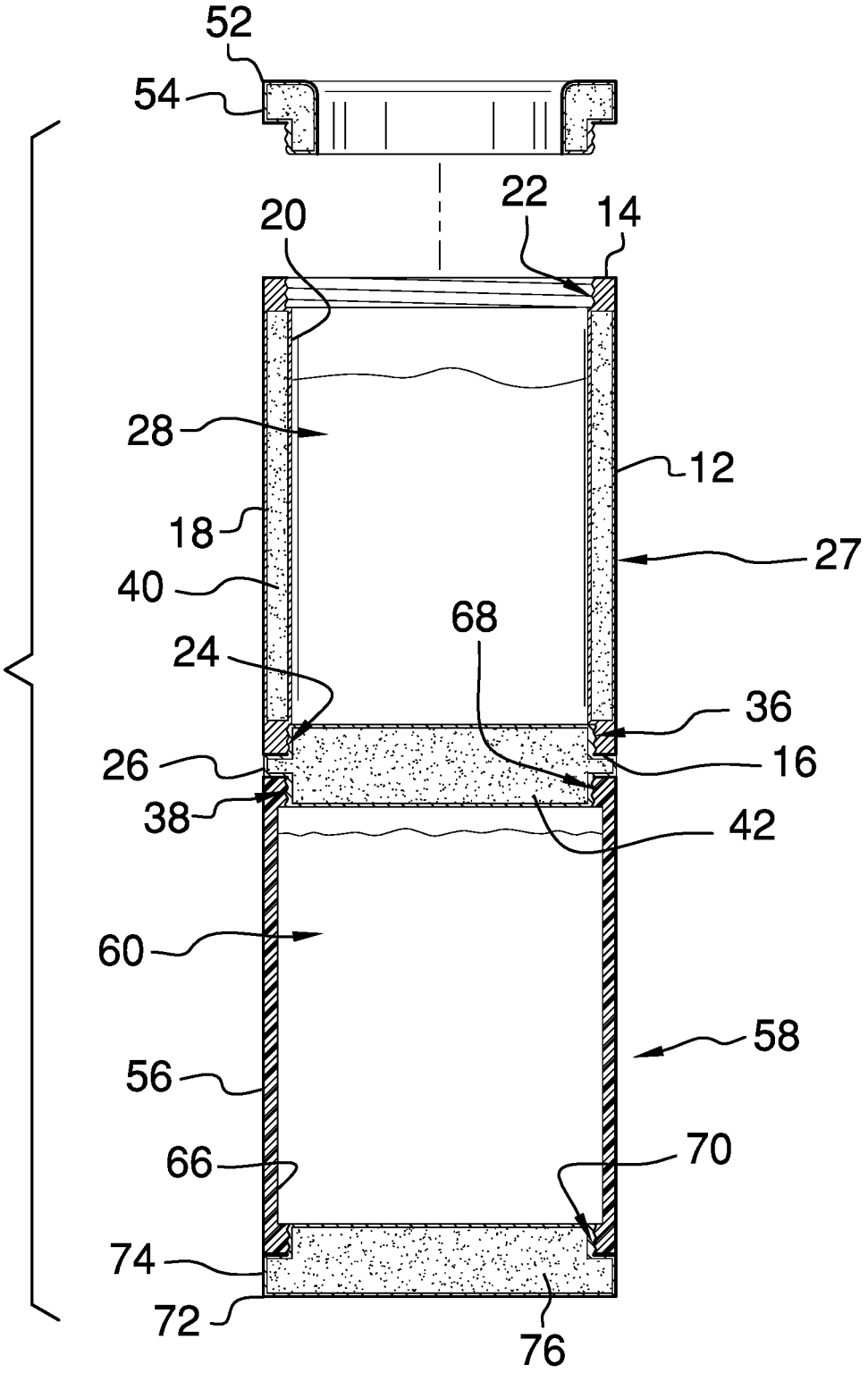
FIG. 5 is a cross sectional view taken along line 5-5 of FIG. 1 of an embodiment of the disclosure.

As shown in FIG. 3, a third sleeve 78 may be provided and an additional disk 80 may be provided. The additional disk 80 may be threadably coupled to the secondary portion 70 of the second sleeve 56. The third sleeve 78 may be threadably coupled to the additional disk 80 to define a third container 82. Additionally, the second cap 72 may be threadably coupled to the third sleeve 78 to close the third sleeve 78.

In use, the disk 26 is coupled to the first end 14 of the first sleeve 12 to form the first container 27 and the first beverage 28 is poured into the first container 27. The first cap 44 is coupled to the second end 16 of the first sleeve 12 to close the first sleeve 12. A drinking straw is extendable through the aperture 46 in the first sleeve 12 from drinking the first beverage 28. Alternatively, the ring 52 is coupled to the first end 14 of the first sleeve 12 to facilitate the first beverage 28 to be poured from the first sleeve 12. The primary end 30 of the second sleeve 56 is coupled to the disk 26 to form the second container 58 and the second beverage 60 is poured into the second container 58. The second cap 72 is coupled to the secondary end 32 of the second sleeve 56 to close the second sleeve 56. The second insulator 42 inhibits thermal communication between the first beverage 28 and the second beverage 60. In this way two beverages of differing 52 temperatures can be transported in the first 27 and second 58 containers.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A multiple beverage container assembly being configured to discretely contain a plurality of beverages, said assembly comprising:

a first sleeve, said first sleeve having a first end, a second end and outer wall extending therebetween, said outer wall having an inner surface, said inner surface having a first threaded portion extending from said first end toward said second end, said inner surface having a second threaded portion extending from said second end toward said first end, said outer wall being hollow, said first sleeve being symmetrical about a central axis perpendicular to a longitudinal axis of said first sleeve;

a disk being removably coupled to said first sleeve such that said first sleeve and said disk forms a first container for containing a first beverage;

a first cap threadably engaging said first sleeve to close said first sleeve, said first cap having an aperture extending therethrough for having a drinking straw being extended therethrough;

a second sleeve being removably coupled to said disk such that said second sleeve and said disk forms a second container for discretely containing a second beverage with respect to the first beverage;

a second cap threadably engaging said second sleeve to close said second sleeve.

2. The assembly according to claim 1, wherein said disk has a primary end, a secondary end and an outer surface extending therebetween, said outer surface having a first threaded portion extending from said primary end toward said secondary end, said outer surface having a second threaded portion extending from said secondary end toward said primary end.

3. The assembly according to claim 2, wherein said first end of said first sleeve insertably receives said primary end having said first threaded portion of said disk threadably engaging said first threaded portion on said first sleeve, each of said first threaded portion and said second threaded portion being recessed on said outer surface of said disk, said disk forming a fluid impermeable seal with said first sleeve, said disk being hollow.

4. The assembly according to claim 2, further comprising a second insulator being positioned within said disk, said second insulator being comprised of a thermally insulating material to inhibit thermal communication between the first beverage and ambient air.

5. The assembly according to claim 2, wherein said second sleeve has a primary end, a secondary end and an inside surface, said inside surface having a primary threaded portion extending from said primary end toward said secondary end, said inside surface having a secondary threaded portion extending from said secondary end toward said primary end.

6. The assembly according to claim 5, wherein said primary end insertably receives said secondary end of said disk having said second threaded portion on said disk threadably engaging said primary threaded portion on said second sleeve, said disk forming a fluid impermeable seal with said second sleeve.

7. The assembly according to claim 5, wherein said second cap has an outwardly facing surface, said outwardly facing surface being threaded to threadably engage said secondary threaded portion on said second sleeve to close said second sleeve, said threads on said second cap being recessed on said outwardly facing surface, said second cap being hollow.

8. The assembly according to claim 7, further comprising a third insulator being positioned within said second cap, said third insulator being comprised of a thermally insulating material to inhibit thermal communication between the second beverage and ambient air.

9. The assembly according to claim 1, further comprising a first insulator being positioned within said outer wall of said first sleeve, said first insulator being comprised of a thermally insulating material to inhibit thermal communication between the first beverage and ambient air.

10. The assembly according to claim 1, wherein said first cap has an outer edge, said outer edge being threaded to threadably engage said first threaded portion of said first sleeve, said threads on said first cap being recessed on said outer edge.

11. The assembly according to claim 1, further comprising a ring having an outside edge, said outside edge being threaded to threadably engage said first threaded portion of said first sleeve for facilitating the beverage to be drank through said ring, said threads on said ring being recessed on said outside edge.

12. A multiple beverage container assembly being configured to discretely contain a plurality of beverages, said assembly comprising:

a first sleeve having a first end, a second end and outer wall extending therebetween, said outer wall having an inner surface, said inner surface having a first threaded portion extending from said first end toward said second end, said inner surface having a second threaded portion extending from said second end toward said first end, said outer wall being hollow, said first sleeve being symmetrical about a central axis perpendicular to a longitudinal axis of said first sleeve;

a disk being removably coupled to said first sleeve such that said first sleeve and said disk forms a first container for containing a first beverage, said disk having a primary end, a secondary end and an outer surface extending therebetween, said outer surface having a first threaded portion extending from said primary end toward said secondary end, said outer surface having a second threaded portion extending from said secondary end toward said primary end, said first end of said first sleeve insertably receiving said primary end having said first threaded portion of said disk threadably engaging said first threaded portion on said first sleeve, each of said first threaded portion and said second threaded portion being recessed on said outer surface of said disk, said disk forming a fluid impermeable seal with said first sleeve, said disk being hollow;

a first insulator being positioned within said outer wall of said first sleeve, said first insulator being comprised of a thermally insulating material to inhibit thermal communication between the first beverage and ambient air;

a second insulator being positioned within said disk, said second insulator being comprised of a thermally insulating material to inhibit thermal communication between the first beverage and ambient air;

a first cap threadably engaging said first sleeve to close said first sleeve, said first cap having an aperture extending therethrough for having a drinking straw being extended therethrough, said first cap having an outer edge, said outer edge being threaded to threadably engage said first threaded portion of said first sleeve, said threads on said first cap being recessed on said outer edge;

a ring having an outside edge, said outside edge being threaded to threadably engage said first threaded portion of said first sleeve for facilitating the beverage to be drank through said ring, said threads on said ring being recessed on said outside edge;

a second sleeve being removably coupled to said disk such that said second sleeve and said disk forms a second container for discretely containing a second beverage with respect to the first beverage, said second sleeve having a primary end, a secondary end and an inside surface, said inside surface having a primary threaded portion extending from said primary end toward said secondary end, said inside surface having a secondary threaded portion extending from said secondary end toward said primary end, said primary end insertably receiving said secondary end of said disk having said second threaded portion on said disk threadably engaging said primary threaded portion on said second sleeve, said disk forming a fluid impermeable seal with said second sleeve;

a second cap threadably engaging said second sleeve to close said second sleeve, said second cap having an outwardly facing surface, said outwardly facing surface being threaded to threadably engage said secondary threaded portion on said second sleeve to close said second sleeve, said threads on said second cap being recessed on said outwardly facing surface, said second cap being hollow; and a third insulator being positioned within said second cap, said third insulator being comprised of a thermally insulating material to inhibit thermal communication between the second beverage and ambient air.

* * * * *